United States Patent [19]

Wilson

[11] 4,329,972

[45] May 18, 1982

[54] ARCHERY BOW AND ARROW STABILIZER

[76] Inventor: Philip H. Wilson, R.D. #2, Campbell, N.Y. 14821

[21] Appl. No.: 191,363

[22] Filed: Sep. 29, 1980

[51] Int. Cl.[3] ..... F41B 5/00

[52] U.S. Cl. ..... 124/24 R; 33/265

[58] Field of Search ..... 124/24 R, 41 A, 87, 124/23 R, 35 A, 86, 88; 33/265

[56] References Cited

U.S. PATENT DOCUMENTS

| | | | |
|---|---|---|---|
| 2,816,537 | 12/1957 | Irwin | 124/24 R |
| 3,512,512 | 5/1970 | Wentz | 124/24 R |
| 3,794,012 | 2/1974 | Ramsey | 124/41 A X |
| 3,895,621 | 7/1975 | Kellogg | 124/24 R |
| 4,026,032 | 5/1977 | Smith | 124/87 X |

*Primary Examiner*—Richard C. Pinkham
*Assistant Examiner*—William R. Browne
*Attorney, Agent, or Firm*—George E. Clark

[57] ABSTRACT

An archery bow has a frame rearwardly extending mounted on the bow. The frame is adjustable to meet the requirements of the arm length of the user. The frame is generally U-shaped having first and second mounting points on the bow above and below the point at which the forward hand supports the bow and where the forward portion of the arrow rests. The rearward portion of the frame rests against the user's chest or shoulder or whatever other part of the user's body which the user chooses to employ as a rear anchor point. An adjustable bar is moveably mounted on the frame member being slideably mounted having holes in the upper and lower portion of the adjustable bar so that it may be moved along the arms of the frame. Structure for fixing the adjustable bar in a desired location on the frame is included. Such structure may be set screws or the like. The adjustable bar includes a hand grip for the rear hand of the user and an arrow stop for precisely positioning the arrow in a repeatable manner. A rear sight may also be mounted on the adjustable bar if desired. In a preferred embodiment, the bow is shortened and a pulley arrangement of the bow string is used to provide a more compact and easier to handle device.

5 Claims, 5 Drawing Figures

ARCHERY BOW AND ARROW STABILIZER

BACKGROUND OF THE INVENTION

The present invention relates to archery bows and more particularly to archery bows having means for stabilizing the rear anchor point and for repeatably positioning the bow string at full draw.

PRIOR ART

The following is a list of United States Patents of which the inventor is aware at the time of filing the present application for patent:

U.S. Pat. No. 2,714,337 which shows an archery bow having a "U-shaped forearm guard extending rearwardly." The patent relates to an archery bow structure which does not require a stong pull and which has means for varying the force of the pull necessary to operate the bow. It further provides for an equalizing mechanism for equalizing the forces at each end of the bow in order to insure direct thrust on the arrow at the midsection of the string. The U-shaped forearm guard 89 extends rearwardly from the hand grip to protect the left forearm of the archer from contact with the bow string (assuming a right-handed archer). The patent does not teach nor suggest a structure such as the instant invention.

U.S. Pat. No. 3,015,328 shows an aim improver for bow and arrow which consist of a bow attached bar extending rearwardly and having a hand grip member attached at the end. The patent does not include means for anchoring the bow aganst the user's body as is shown and claimed in the present application.

U.S. Pat. No. 3,056,206 relates to a multi-use bow sight which does not relate to means for repeatably positioning the bow or the arrow at full draw as does the instant invention.

U.S. Pat. No. 3,561,418 shows an archery bow having telescoping members mounted that extend rearwardly of the bow. A hand hold member is used to support the bow string during the stressing thereof.

The apparatus of the patent requires extensive modification to the bow and does not include means for anchoring the bow and the arrow when the bow is in the full draw position.

U.S. Pat. No. 3,648,376 shows a bow sight device consisting of a vertical metal strap attached to the bow with a vertical adjustable sighting unit. This patent does not show means for repeatably positioning the arrow or the bow at full draw.

U.S. Pat. No. 3,667,444 shows an archery bow sighting mechanism having a telescopic sight windage attachment and a locating element which positions the sighting mechanism adjacent to a point on the archer's head.

The structure of the patent does not show a bow structure such as the present invention.

U.S. Pat. No. 3,794,012 shows an archery bow with a collapsible bow arm rest and pull assembly so that when the bow has been pulled to full draw by the archer, the arm rest lock in position to hold the bow in the full draw position. The patent does not show a frame for repeatably positioning the bow in the full draw position at a rear anchor point as is shown by the present invention.

U.S. Pat. No. 4,162,579 shows an archery sighting device including an elongated arm which is adapted to provide horizontal and vertical adjustment of a sight.

The patent does not show stucture according to the present invention.

SUMMARY OF THE INVENTION

Accordingly, it is a primary object of the present invention to provide an archery bow having means for reliably and repeatably positioning the bow string at full draw and for positioning and stabilizing the rear anchor point at full draw.

It is another object of the present invention to provide an archery bow as above having a frame attached to the bow for repeatably positioning a rear anchor point from greater accuracy and ease of use of the bow.

It is another object of the present invention to provide an archery bow as above wherein a rear arrow stop is mounted on the frame for reliably and repeatably positioning the bow string and the rear anchor point at full draw in a reapeatable manner.

It is yet another object of the present invention to provide an archery bow as above wherein the arrow stop further includes a hand grip to faciliate use by the archer.

It is yet a further object of the present invention to provide an archery bow as above wherein the frame may be adjusted for distance from the bow rearward as required based upon the length of the archer's arm.

It is yet another object of the present invention to provide an archery bow wherein the bar carrying the rear arrow stop and hand grip is slideably mounted along the frame to adapt the bow for shooting short light weight arrows to improve range and accuracy of the bow.

Therefore, an archery bow has a frame attached to the bow member in a manner to allow length adjustment of said frame. The frame has slideably mounted thereon a bar which provides a rear arrow stop and a hand grip. The bar is adjusted along said frame to provide a rear arrow stop and hand grip when the arrow is at full draw. The adjustability is provided so that short light weight arrows may be used to improve range and repeatable accuracy of the bow. A rear sight may be mounted on the adjustable bar or on the frame as desired by the archer.

It is an advantage of the present invention that the rear anchor point in archery bow shooting may be located an stabilized in a repeatable manner through the use of the frame according to the present invention.

It is another advantage of the present invention that through the use of the adjustable rear arrow stop, short light weight arrows may be accommodated for increased range and accuracy.

These and other objects of the present invention will become immediately apparent from the following detailed description in conjunction with the accompanying drawing.

DETAILED DESCRIPTION OF A PREFERRED EMBODIMENT OF THE INVENTION

Figure 1:
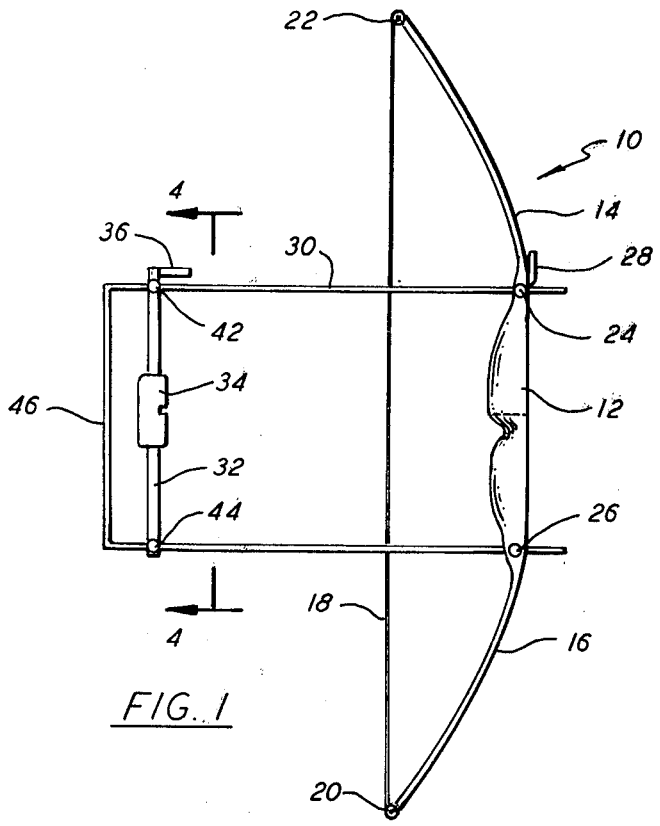
FIG. 1 is a side view of an archery bow including a preferred embodiment of the present invention.
Figure 2:
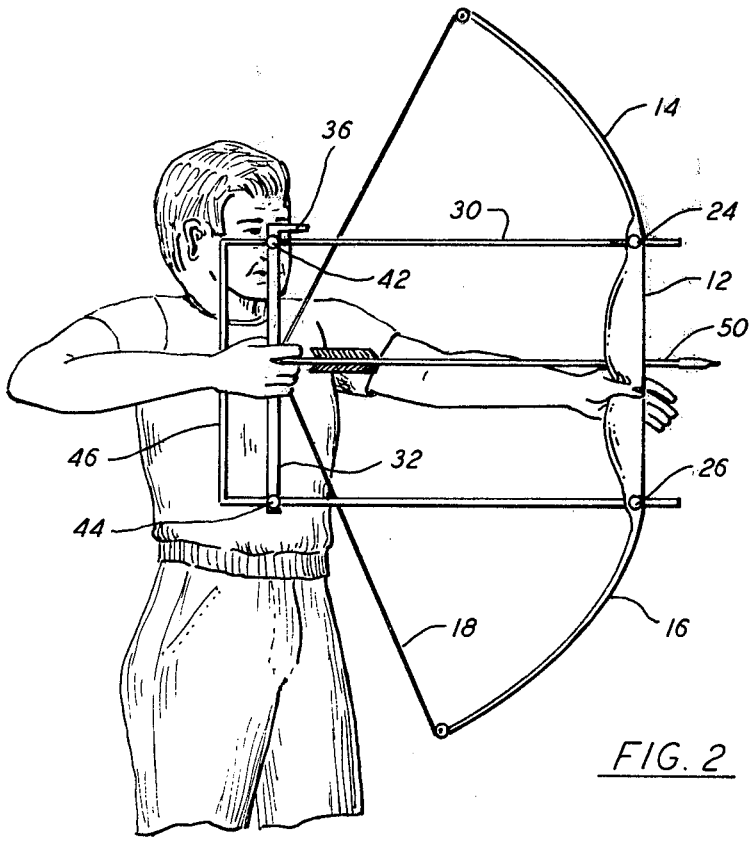
FIG. 2 is a perspective view of an archery bow according to the present invention shown in full draw position as used by an archer.

Referring now to FIGS. 1 and 2, a preferred embodiment of the present invention will be described.

An archery bow 10 has a center body section 12 and bow limbs 14 and 16. A draw cable 18 is mounted to the bow 10 through pulleys 20 and 22. A stabilizing frame 30 is slideably mounted in center section 12 of bow 10 and held in place by set screws 24 and 26 at the top and bottom of the stabilizing frame respectively. A front sight 28 is mounted on center section 12 of bow 10 near the top thereof to provide a front aiming point for the archer. Stabilizing frame 30 has slideably mounted thereon bar 32 which is adjusted to a position determined by the length of arrow 50 and locked in place by set screws 42 and 44 which hold bar 32 in position relative to frame 30. A hand grip and arrow stop 34 is mounted approximately in the center of bar 32 in line with the arrow rest on center section 12 of bow 10. Rear sight 36 is mounted at the top of bar 32 so that when the bar 32 is properly positioned rear sight 36 is proper alignment adjacent to the archer's shooting eye.

Rear section 46 of frame 30 rests against the archer's body at either the shoulder or chest to provide a rear stabilizing point for accurate repeatably archery bow shooting.

Figure 3:
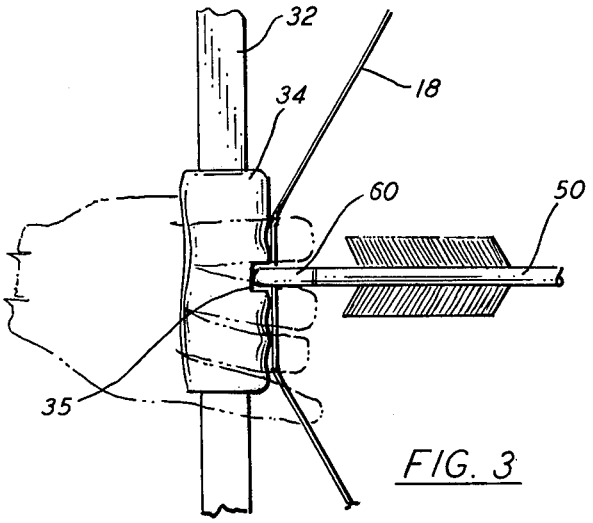
FIG. 3 is a side view of a hand grip and rear arrow stop as employed in a preferred embodiment of the present invention.

Referring now to FIG. 3, the details of the hand grip and arrow stop mounted on bar 32 will be further set forth. Arrow stop 34 has a notch 35 to permit the arrow nock 60 room to allow cable 18 to be pulled firmly against arrow stop 34 at full draw. Hand grip 34 may include molded indentations to conform to an archer's hand and fingers.

Figure 4:
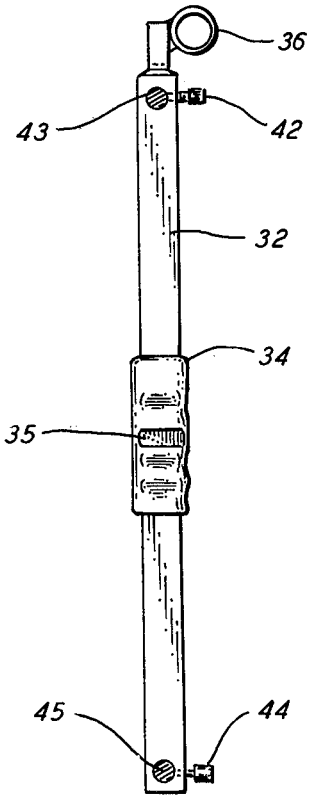
FIG. 4 is a front view of a slideably mounted bar carrying rear arrow stop and hand grip and rear sight according to the present invention.

Referring now to FIG. 4, a front view of bar 32, mounting of bar 32 will be described. Bar 32 has holes 43 and 45 therein near the top and bottom of bar 32 respectively which allows frame 30 to pass through bar 32. After a position has been selected for bar 32 by the archer, the frame is locked in position by set screws 42 and 44 which bear on frame 30 at the sides of holes 43 and 45 respectively. Hand grip and arrow stop 34 may be slideably mounted on bar 32 to permit adjustment in the vertical direction of the arrow stop from slack position to full draw of the arrow. Rear sight 36 is mounted at the top of bar 32 in a position to be in line with front sight 28 and the archer's shooting eye.

Figure 5:
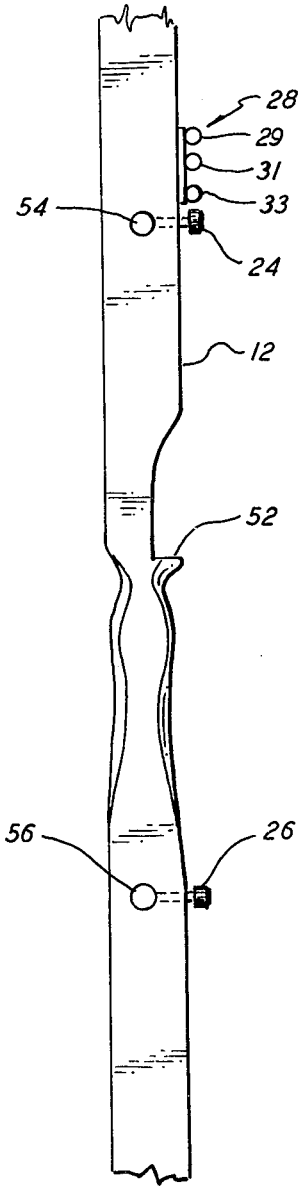
FIG. 5 is a rear view of a bow frame adapted for use with the present invention.

Referring now to FIG. 5, center section 12 of bow 10 will be further described. Holes 54 and 56 permit forward portions of frame 30 to pass there through after frame 30 has been adjusted by the archer for proper length at full draw and for stabilizing position against the archer's body, frame 30 is locked in position at center section 12 of bow 10 by set screws 24 and 26 respectively. Arrow rest 52 is shown on section 12 which guides the arrow as cable 18 is released from the full draw position. Front sight 28 is shown as having three separate beads 29, 31 and 33 which may be used to assist aiming at three different shooting differences. Many other front or rear sights could be chosen to be used with an archery bow according to the present invention.

In operation, an archer once frame 30 and bar 32 have been properly adjusted for the archer, bow size and arrow length, the archer may pull cable 18 and arrow 50 to the full draw position against arrow stop and hand grip 34 and hold the bow in the full draw position using one hand. Frame 30 which bears against the body of the archer at rear section 46 provides a stabilizing point to permit reliable and repeatable bow and arrow shooting.

Although a preferred embodiment of the invention has been described, it will be apparent to those skilled in the art that there are many variations and modifications which may be made without departing from the spirit or scope of the invention. Therefore, the invention is not to be limited by the specific disclosure of a preferred embodiment herein, but only by the appended claims.

What is claimed is:

1. An archery bow having a flexible frame and a cable attached to said flexible frame for propelling an arrow, comprising:

a rigid unitary stabilizing member mounted on said flexible frame and positioned to bear against an area of an archer's body trunk portion at a point selected by an archer, said stabilizing member being attached to said flexible frame at first and second positions on said flexible frame and wherein said stabilizing member is of a substantial U-shape, said stabilizing member further having mounted thereon a bar which comprises a centrally mounted hand grip and arrow stop; and means for fixing said bar in a position on said stabilizing member to position said arrow stop at a predetermined point for an arrow length selected by said archer.

2. An archery bow according to claim 1 further including a front sight mounted on said flexible frame and a rear sight mounted on said stabilizing member.

3. An archery bow according to claim 1 wherein said stabilizing member is slideably mounted on said flexible frame and held in a selected position by securing means.

4. An archery bow according to claim 1 wherein said arrow stop further includes a recessed portion to permit full draw of the archery bow without interference between the nock of an arrow used with said archery bow.

5. An archery bow according to claim 1 wherein said hand grip is molded to conform to an archer's hand.

* * * * *